US008655238B2

(12) United States Patent
Uno et al.

(10) Patent No.: US 8,655,238 B2
(45) Date of Patent: Feb. 18, 2014

(54) DEVELOPING MEMBER

(71) Applicant: Canon Kabushiki Kaisha, Tokyo (JP)

(72) Inventors: Masashi Uno, Mishima (JP); Takashi Kusaba, Suntou-gun (JP); Shohei Urushihara, Suntou-gun (JP); Ryo Sugiyama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/861,271

(22) Filed: Apr. 11, 2013

(65) Prior Publication Data

US 2013/0223892 A1 Aug. 29, 2013

Related U.S. Application Data

(63) Continuation of application No. PCT/JP2012/007388, filed on Nov. 16, 2012.

(30) Foreign Application Priority Data

Dec. 9, 2011 (JP) ..... 2011-270638
Nov. 13, 2012 (JP) ..... 2012-249648

(51) Int. Cl.
*G03G 15/08* (2006.01)

(52) U.S. Cl.
USPC ..... 399/286

(58) Field of Classification Search
USPC ..... 399/279, 286
See application file for complete search history.

(56) References Cited

U.S. PATENT DOCUMENTS 6,319,181 B1 * 11/2001 Naoi et al. ..... 492/56
2005/0084690 A1 * 4/2005 Matsunaka et al. ..... 428/447
2008/0292366 A1 * 11/2008 Akama et al. ..... 399/286

(Continued)

FOREIGN PATENT DOCUMENTS

JP 10-333422 A 12/1998
JP 11-12471 A 1/1999

(Continued)

OTHER PUBLICATIONS

PCT International Search Report and Written Opinion of the International Searching Authority, International Application No. PCT/JP2012/007388, Mailing Date Dec. 18, 2012.

*Primary Examiner* — G. M. Hyder
(74) *Attorney, Agent, or Firm* — Fitzpatrick, Cella, Harper and Scinto

(57) ABSTRACT

Provided is a developing roller including elastic layer and resin layer adhered to each other and having an appropriately resistance, thereby suppressing fogging. The developing member comprises a mandrel; an elastic layer; and a resin layer, wherein: the resin layer comprises polyurethane resin obtained by isocyanate and polyol; and the elastic layer includes cured silicone rubber composition comprising (a)-(d):

(a) organopolysiloxane having two or more alkenyl groups bonded to silicon atom and having methyl group as a group other than the alkenyl bonded to the silicon;
(b) organopolysiloxane having three or more hydrogen atoms bonded to silicon atom and having methyl group as a group bonded to the silicon;
(c) carbon black;
(d) organopolysiloxane represented by formula (1) and having Mw of 18,000-110,000 and Mw/Mn of 1.0-2.0 ($R^1$ represents alkenyl group, $R^2$ represents functional group reacting with isocyanate, and n represents an integer of 1 or more).

(1)

6 Claims, 2 Drawing Sheets

(56) References Cited

U.S. PATENT DOCUMENTS

| | | | | |
|---|---|---|---|---|
| 2009/0010684 | A1* | 1/2009 | Satoh et al. | 399/286 |
| 2013/0142548 | A1* | 6/2013 | Suzuki et al. | 399/286 |
| 2013/0164038 | A1* | 6/2013 | Kusaba et al. | 399/252 |

FOREIGN PATENT DOCUMENTS

| | | | |
|---|---|---|---|
| JP | 2004-126178 | A | 4/2004 |
| JP | 2005-300752 | A | 10/2005 |
| JP | 2009-138190 | A | 6/2009 |

* cited by examiner

DEVELOPING MEMBER

CROSS-REFERENCE TO RELATED APPLICATIONS

This application is a continuation of International Application No. PCT/JP2012/007388, filed Nov. 16, 2012, which claims the benefit of Japanese Patent Applications No. 2011-270638, filed Dec. 9, 2011 and No. 2012-249648 filed Nov. 13, 2012.

BACKGROUND OF THE INVENTION

1. Field of the Invention

The present invention relates to a developing member and an electrophotographic apparatus.

2. Description of the Related Art

As a developing system in an electrophotographic apparatus such as a copier, a printer, or a receiving device of a facsimile, there has been widely used a one-component developing system using one-component toner.

As a developing member to be used in the developing system using one-component toner, there has been known a configuration in which an electro-conductive elastic layer containing silicone rubber in which carbon black is dispersed is formed on an outer side of an electro-conductive mandrel and a urethane resin layer is formed on an outer side of the elastic layer.

In the developing member having a configuration in which the elastic layer and the resin layer are laminated as described above, there is a risk in that adhesiveness between the elastic layer and the resin layer may be degraded due to a long-term use, and may cause interfacial peeling between the elastic layer and the resin layer.

Japanese Patent Application Laid-Open No. H11-012471 discloses a developing roller in which a urethane resin layer is provided on a silicone rubber layer via a primer containing γ-aminopropyltrimethoxysilane as its main component to greatly enhance the adhesive strength between the silicone rubber layer and the urethane resin layer.

SUMMARY OF THE INVENTION

However, according to the study conducted by the inventors of the present invention, when a urethane layer was provided on a silicone rubber layer, which had been made electro-conductive with carbon black or the like, via a silane coupling agent as disclosed in Patent Literature 1, the conductivity of the silicone rubber layer was degraded in some cases.

In view of the foregoing, the present invention is directed to providing a developing member excellent in adhesive strength between an electro-conductive elastic layer containing carbon black and silicone rubber and a surface layer containing a urethane resin without impairing satisfactory conductivity of the elastic layer.

Further, the present invention is directed to providing an electrophotographic apparatus capable of stably providing a high-quality electrophotographic image.

According to one aspect of the present invention, there is provided a developing member, comprising in the following order: a mandrel; an elastic layer; and a resin layer, wherein: the resin layer comprises a polyurethane resin obtained by reacting an isocyanate compound with a polyol compound; and the elastic layer comprises a cured product of an addition polymerization type silicone rubber composition comprising the following (a) to (d):

(a) an organopolysiloxane having two or more alkenyl groups bonded to a silicon atom in one molecule and having a methyl group as a group other than the alkenyl groups bonded to the silicon atom;

(b) an organopolysiloxane having three or more hydrogen atoms bonded to a silicon atom in one molecule and having a methyl group as a group bonded to the silicon atom;

(c) carbon black; and (d) an organopolysiloxane represented by the following formula (1) and having a weight average molecular weight Mw of 18,000 or more and 110,000 or less and a molecular weight distribution Mw/Mn, where Mn represents a number average molecular weight, of 1.0 or more and 2.0 or less.

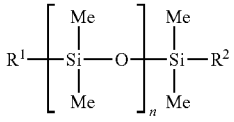

(1)

(In the formula (1), $R^1$ represents an alkenyl group having 2 or more and 4 or less carbon atoms, $R^2$ represents a functional group capable of reacting with an isocyanate group, and n represents an integer of 1 or more.)

According to another aspect of the present invention, there is provided an electrophotographic apparatus, comprising: a photosensitive member; and a developing member placed to abut on the photosensitive member, wherein the developing member comprises the above-described developing member.

According to the present invention, there is provided the developing roller in which the silicone rubber elastic layer and the polyurethane resin layer are firmly adhered to each other and the electrical resistance are appropriately controlled, thereby suppressing fogging.

Further features of the present invention will become apparent from the following description of exemplary embodiments with reference to the attached drawings.

DESCRIPTION OF THE EMBODIMENTS

Figure 1:
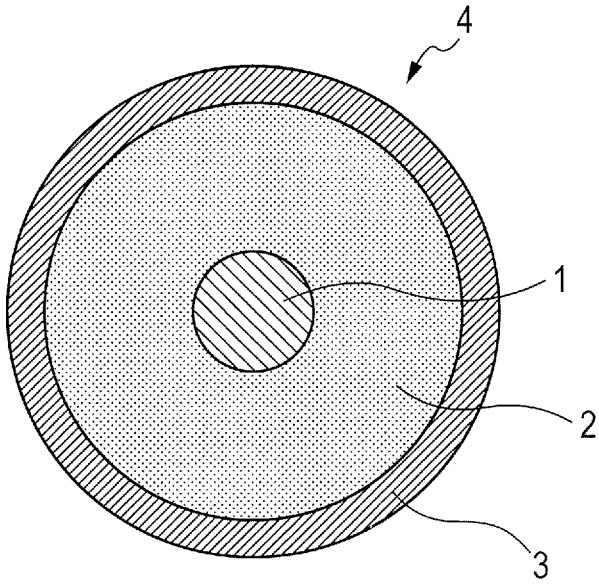
FIG. 1 is a schematic view illustrating an example of a developing roller according to the present invention.

Preferred embodiments of the present invention will now be described in detail in accordance with the accompanying drawings.

When a urethane resin layer is provided on a silicone rubber elastic layer in which carbon black is dispersed via a silane coupling agent, the conductivity of the silicone rubber elastic layer is degraded. The cause for the degradation in conductivity is not clear, but the inventors of the present invention presume the cause as follows.

That is, a low-molecular-weight organic silane compound contained in a silane coupling agent applied onto the surface of the elastic layer permeates into the elastic layer. On the other hand, various functional groups such as a hydroxyl group and a carboxyl group are present on the surface of carbon black, and these functional groups easily react with a reactive functional group of the low-molecular-weight organic silane compound to form a chemical bond. As a result, the carbon black is bonded to a cross-linking structure of silicone rubber constituting the elastic layer, which limits the movement of carbon black in the elastic layer.

In order for carbon black to function as an electro-conductive agent, it is considered that it is necessary for particles of carbon black to form a primary aggregate and create an electro-conductive path. When the movement of carbon black in the silicone rubber elastic layer is limited as described above, an electro-conductive path becomes unlikely to be formed. As a result, it is considered that a developing roller in which a low-molecular-weight organic silane compound is added as an adhesiveness-imparting component has an increased resistance, with the result that appropriate conductivity cannot be obtained.

Thus, in order to allow a silicone rubber elastic layer and a urethane resin layer to adhere to each other firmly without impairing the conductivity of a developing roller, the inventors of the present invention studied an adhesiveness-imparting component capable of enhancing the adhesiveness between the urethane resin layer and the silicone rubber elastic layer without inhibiting the movement of carbon black.

As a result, the inventors of the present invention found that, by forming a silicone rubber elastic layer of a cured product of an addition polymerization type silicone rubber composition containing an organopolysiloxane represented by the following formula (1), the adhesive strength between the silicone rubber elastic layer and the urethane resin can be enhanced without impairing the conductivity of the silicone rubber elastic layer.

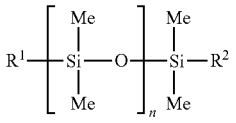

(1)

In the formula (1), $R^1$ represents an alkenyl group having 2 or more and 4 or less carbon atoms, $R^2$ represents a functional group capable of reacting with an isocyanate group, and n represents an integer of 1 or more.

The organopolysiloxane represented by the formula (1) has a functional group $R^2$ capable of reacting with an isocyanate group at one terminal of a molecular chain. That is, the functional group $R^2$ is capable of being bonded to a functional group of a material for a polyurethane resin contained in the resin layer.

Further, the organopolysiloxane represented by the formula (1) has an alkenyl group at the other terminal of the molecular chain, which is capable of forming a chemical bond with a cross-linking network of silicone rubber through a hydrosilylation reaction. Therefore, by using an addition polymerization type silicone rubber composition containing the organopolysiloxane represented by the formula (1) for forming an elastic layer, the adhesiveness between the elastic layer and the resin layer can be enhanced.

Meanwhile, the function group $R^2$ of the organopolysiloxane represented by the formula (1) is also capable of reacting with a functional group present on the surface of particles of carbon black. Therefore, in the same way as in the case of using a conventional low-molecular-weight organic silane compound, carbon black is bonded to a cross-linking network of silicone rubber via a molecular chain of the organopolysiloxane represented by the formula (1).

However, the organopolysiloxane has a weight average molecular weight Mw of 18,000 or more and 110,000 or less. Therefore, carbon black can move freely to some degree even when being bonded to a cross-linking network. As a result, formation of an electro-conductive path is unlikely to be prevented, and a developing roller having appropriate conductivity can be produced.

It should be noted that the organopolysiloxane represented by the formula (1) has a molecular weight distribution Mw/Mn (Mn represents a number average molecular weight) of 1.0 or more and 2.0 or less. When the organopolysiloxane has such molecular weight distribution, low-molecular-weight components which are liable to inhibit the movement of carbon black and high-molecular-weight components which are difficult to contribute to an adhesion function can be reduced, and both expression of an appropriate resistance and adhesiveness with a resin layer can be exhibited sufficiently.

FIG. 1 is a cross-sectional view of a developing roller according to an embodiment of a developing member of the present invention. In a developing roller 4 in the figure, an elastic layer 2 and a resin layer 3 are laminated in this order on an outer circumference of a mandrel 1.

<Elastic Layer>

The addition polymerization type silicone rubber composition to be used for the elastic layer is described below. The silicone rubber composition as used herein refers to a resin material containing an organopolysiloxane as a main raw material. As required, there may be blended any of various additives, for example: an electro-conductive agent such as carbon black; a filler such as quartz powder, diatomaceous earth, dry silica, or wet silica; a reaction inhibitor for adjusting a curing rate; a colorant; a plasticizer; and a flame retarder. The silicone rubber composition to be used in the present invention includes the following components (a) to (d) as essential components.

(Component (a))

The component (a) of the silicone rubber composition is an organopolysiloxane having two or more alkenyl groups bonded to a silicon atom in one molecule and having a methyl group as a group other than the alkenyl groups bonded to the silicon atom. It is preferred that the component (a) have a weight average molecular weight Mw of from 10,000 to 200,000. Examples of the alkenyl groups include a vinyl group, an allyl group, a propenyl group, an isopropenyl group, a butenyl group, an isobutenyl group, a pentenyl group, and a hexenyl group. Of those, a vinyl group is preferred. The alkenyl groups may be bonded to a silicon atom at a terminal or in the middle of the molecular chain.

(Component (b))

The component (b) of the silicone rubber composition is an organopolysiloxane having three or more hydrogen atoms bonded to a silicon atom in one molecule and having a methyl group as a group bonded to the silicon atom. It is preferred that the component (b) have a weight average molecular weight Mw of from 300 to 100,000. The hydrogen atoms of a hydrosilyl group may be bonded to a silicon atom at a terminal or in the middle of the molecular chain. It is preferred that the content of the component (b) be such an amount that the molar ratio of hydrogen atoms bonded to the silicon atoms of the component (b) with respect to the alkenyl groups bonded to the silicon atoms contained in the components (a) and (e) fall within the range of 1.0 or more and 5.0 or less.

(Component (c))

The component (c) of the silicone rubber composition is carbon black for imparting conductivity and reinforcing property to the elastic layer of the developing roller. In general, those which are used as a conductivity-imparting agent of a silicone rubber composition can be used. Examples of such carbon black include acetylene black, furnace black, thermal black, and channel black. In order to impart appropriate conductivity and reinforcing property to the developing roller, it is preferred that the carbon black have an average primary particle diameter of 10 nm or more and 100 nm or less. It is also preferred that the carbon black have a DBP oil-absorbing amount of 30 ml or more and 200 ml or less per 100 g. Further, two or more kinds of carbon blacks may be blended depending on required physical properties. Further, in order for the conductivity and reinforcing property of the developing roller to fall within an appropriate range, it is preferred that the content of the carbon black be 1 part by mass or more and 15 parts by mass or less with respect to 100 parts by mass of the component (a).

(Component (d))

The component (d) of the silicone rubber composition is a component for imparting the adhesiveness with respect to the polyurethane resin layer to the elastic layer of the developing roller. The component (d) is an organopolysiloxane represented by the formula (1) and having an alkenyl group at one terminal of its molecular chain and a functional group capable of reacting with an isocyanate group at the other terminal of the molecular chain. The organopolysiloxane has a weight average molecular weight Mw of 18,000 or more and 110,000 or less and has a molecular weight distribution Mw/Mn (Mn represents a number average molecular weight) of 1.0 or more and 2.0 or less.

When the weight average molecular weight Mw of the component (d) is 18,000 or more, in the case where the functional group $R^2$ reacts with a functional group on the surface of carbon black particles, the movement of the carbon black particles is less likely to be limited. Therefore, the resistance of the developing roller can be prevented from remarkably increasing. Further, when the weight average molecular weight Mw is 110,000 or less, the number of the functional groups $R^2$ per volume is sufficient, and hence the elastic layer and the resin layer can adhere to each other firmly.

When the molecular weight distribution Mw/Mn of the component (d) is 1.0 or more and 2.0 or less, the ratios of a low-molecular-weight component having a molecular weight of less than 18,000 and a high-molecular-weight component having a molecular weight of more than 110,000 become sufficiently low. Therefore, the resistance of the developing roller can be set in an appropriate range to allow the elastic layer and the resin layer to adhere to each other firmly.

The component (d) has an alkenyl group $R^1$ having 2 or more and 4 or less carbon atoms at one terminal of the molecular chain. It is preferred that the alkenyl group be a vinyl group from the viewpoint of reactivity. Further, the component (d) has a functional group $R^2$ capable of reacting with an isocyanate group at the other terminal of the molecular chain, and examples of the functional group include, but are not limited to, a hydroxyl group, an alkoxyl group, an amino group, and a thiol group. A hydroxyl group and an alkoxyl group are particularly preferred because they are less likely to become a catalyst poison for a hydrosilylation catalyst.

The functional groups $R^1$ and $R^2$ of the component (d) are bonded to the respective terminals of the molecular chain. Therefore, the functional groups are highly reactive and can impart sufficient adhesiveness. Further, all the functional groups on the side position of the molecular chain of the component (d) are methyl groups. In a structure having organic groups other than the methyl groups, the side position of the molecular chain becomes bulky, and the movement of the molecular chain is liable to be prevented in silicon rubber. As a result, when the silicone rubber is bonded to carbon black particles, the movement of the carbon black particles is limited, and sufficient conductivity is not imparted to the developing roller.

The content of the component (d) is preferably 0.5 part by mass or more and 10 parts by mass or less with respect to 100 parts by mass of the component (a).

In this case, the weight average molecular weight Mw, the number average molecular weight Mn, and the molecular weight distribution Mw/Mn can be obtained through measurement using gel permeation chromatography. Specifically, a high performance liquid chromatography analyzer (HLC-8120GPC manufactured by TOSOH CORPORATION) in which two GPC columns (TSKgel SuperHM-m manufactured by TOSOH CORPORATION) are connected in series is used. A measurement sample is a tetrahydrofuran (THF) solution at 0.1% by mass, and is measured by using a refractive index (RI) detector under the measurement conditions of a temperature of 40° C. and a flow rate of 0.6 ml/min. A calibration curve is prepared with monodisperse standard polystyrenes (TSK standard polystyrenes F-128, F-80, F-40, F-20, F-10, F-4, F-2, F-1, A-5000, A-2500, A-1000, and A-500 manufactured by TOSOH CORPORATION) as standard samples. The molecular weight distribution is obtained from the retention time or number of counts of the measurement sample. Based on the distribution, the weight average molecular weight Mw, the number average molecular weight Mn, and the molecular weight distribution Mw/Mn can be determined.

(Component (e))

It is preferred that a catalyst (hereinafter, sometimes referred to as "component (e)") for promoting a hydrosilylation reaction between the components (a) and component (d) and the component (b) be blended in the silicone rubber composition containing the components (a) to (d). As such catalyst, any of those which are known as a catalyst for promoting a hydrosilylation reaction can be used.

Examples of such catalyst include platinum-based, palladium-based, and rhodium-based catalysts. Of those, a platinum-based catalyst is preferred. As the platinum-based catalyst, for example, there are used chloroplatinic acid, an alcohol solution of chloroplatinic acid, a complex of chloroplatinic acid and an olefin, a complex of chloroplatinic acid and vinylsiloxane, and a platinum-supported silica. The addition amount of the catalyst is preferably such an amount that the ratio of the mass of a catalyst metal atom with respect to the mass of the component (a) falls within the range of 1 ppm or more and 100 ppm or less.

In the silicone rubber composition, in addition to the foregoing, various known additives can also be used. For example, a reaction inhibitor for adjusting a curing rate, a filler for imparting reinforcing property, a colorant, a plasticizer, and a flame-resistance-imparting agent may be added as necessary.

As a guideline, the thickness of the elastic layer is preferably 0.5 mm or more and 50 mm or less, more preferably 1 mm or more and 10 mm or less.

<Volume Resistivity of Elastic Layer>

Figure 2:
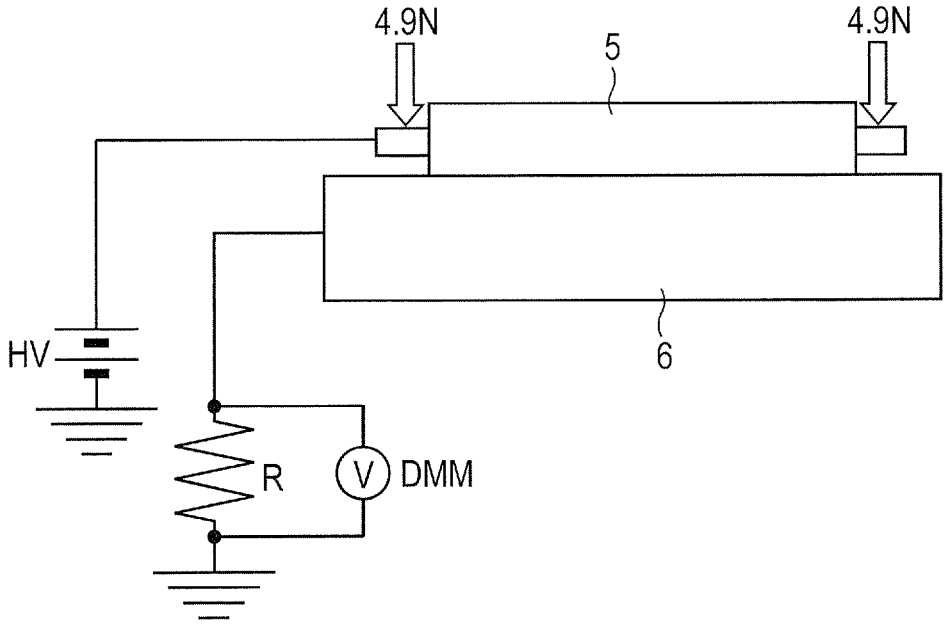
FIG. 2 is a schematic view of an apparatus for measuring an electrical resistance of a developing roller according to the present invention.

It is preferred that the volume resistivity of the elastic layer be $1\times10^4$ Ω·cm or more and $1\times10^7$ Ω·cm or less at a time of application of a DC voltage of 50 V. If the volume resistivity of the elastic layer is $1\times10^4$ Ω·cm or more, even in the case where a bias is applied to a developing blade, a blade bias leakage can be suppressed, and if the volume resistivity of the elastic layer is $1\times10^7$ Ω·cm or less, the occurrence of a fogging image can be suppressed. In this case, as the electrical resistance, a measurement value obtained through use of an electrical resistance measurement apparatus illustrated in FIG. 2 can be adopted.

An elastic roller 5 on which a resin layer is not formed is set in abutment with a metal drum 6 having a diameter of 50 mm under the application of a load of 4.9 N to each of both ends of a mandrel. The metal drum 6 is rotated at a surface velocity of 50 mm/sec, and the elastic roller 5 is driven following the rotation. A resistor R having a known electrical resistance that is an electrical resistance lower by two or more digits than the electrical resistance of the elastic roller 5 is connected between the metal drum 6 and the ground. A voltage of +50 V is applied from a high-voltage power source HV to the mandrel of the elastic roller 5, and an electrical potential difference between both ends of the resistor R is measured through use of a digital multimeter DMM (for example, 189TRUE RMS MULTIMETER, manufactured by Fluke Corporation). A current having flowed to the metal drum 6 through the elastic roller 5 is calculated from the measured value of the electrical potential difference and the electrical resistance of the resistor R, and an electrical resistance of the elastic roller 5 is calculated from the current and the applied voltage of 50 V. In the measurement using the digital multimeter, sampling is performed for 3 seconds after the elapse of 2 seconds from the application of the voltage, and a value calculated from an average value thereof is defined as a resistance of the elastic layer. Subsequently, an area of an abutment portion between the elastic roller 5 and the metal drum 6 is calculated. A volume resistivity of the elastic layer is determined from the resistance of the elastic layer, the area of the abutment portion, and the thickness of the elastic layer.

<Hardness of Elastic Layer>

The elastic layer is required to have appropriate elasticity as a developing roller. Therefore, as the hardness of the elastic layer, for example, an Asker C hardness of the elastic layer is preferably 10° or more and 80° or less. When the Asker C hardness of the elastic layer is 10° or more, the exudation of an oil component from a rubber material constituting the elastic layer can be suppressed, and the contamination of a photosensitive drum can be suppressed. Further, when the Asker C hardness of the elastic layer is 80° or less, toner can be prevented from being degraded, and image quality of an output image can be prevented from decreasing.

In this case, the Asker C hardness can be defined by a measurement value obtained by an Asker rubber hardness meter (manufactured by Kobunshi Keiki Co., Ltd.) through use of a test chip separately produced in accordance with Standard Asker C-type SRIS (Standard of Nippon Rubber Society) 0101.

<Resin Layer>

The resin layer is described. The resin layer is formed of a thermosetting polyurethane resin obtained by reacting an isocyanate compound and a polyol compound.

Examples of the isocyanate compound include diphenylmethane-4,4'-diisocyanate, 1,5-naphthalene diisocyanate, 3,3'-dimethylbiphenyl-4,4'-diisocyanate, 4,4'-dicyclohexylmethane diisocyanate, p-phenylene diisocyanate, isophorone diisocyanate, a carbodiimide-modified MDI, xylylene diisocyanate, trimethylhexamethylene diisocyanate, tolylene diisocyanate, naphthylene diisocyanate, p-phenylene diisocyanate, hexamethylene diisocyanate, and polymethylene polyphenyl polyisocyanate. Those isocyanate compounds may be used alone or in combination of two or more kinds thereof.

Examples of the polyol compound include: divalent polyol compounds (diols) such as ethylene glycol, diethylene glycol, propylene glycol, dipropylene glycol, 1,4-butanediol, hexanediol, neopentylglycol, 1,4-cyclohexanediol, 1,4-cyclohexanedimethanol, xylene glycol, and tryethylene glycol; trivalent or more polyol compounds such as 1,1,1-trimethylolpropane, glycerin, pentaerythritol, and sorbitol; and high-molecular-weight polyol compounds such as polyethylene glycol, polypropylene glycol, and ethylene oxide-propylene oxide block glycol, which are obtained by addition of ethylene oxide, propylene oxide to diols and triols. Those polyol compounds may be used alone or in combination of two or more kinds thereof.

It is preferred that the isocyanate compound be blended with the polyol compound so that an isocyanate index falls within the range of 1.1 or more and 1.5 or less. It should be noted that the isocyanate index indicates a ratio ([NCO]/[OH]) between the molar number of isocyanate groups in the isocyanate compound and the molar number of hydroxyl groups in a polyol compound component. By setting the isocyanate index in the range, the component (e) contained in the elastic layer and the isocyanate compound of the resin layer react with each other easily, with the result that high adhesiveness is obtained, and an excess increase in hardness of the resin layer can be suppressed.

The resin layer may contain the carbon black so as to impart appropriate conductivity and reinforcing property. The carbon black to be contained in the resin layer may be exemplified by those which are similar to those exemplified as the carbon black to be used in the elastic layer.

The resin layer may contain fine particles each having a volume average particle diameter of 1 μm or more and 20 μm or less so as to impart appropriate surface roughness to the surface of a developing roller. Examples of the fine particles include plastic pigments of polymethyl methylmethacrylate fine particles, silicone rubber fine particles, polyurethane fine particles, polystyrene fine particles, amino resin fine particles, and phenol resin fine particles.

As a guideline, the thickness of the resin layer is preferably 1 μm or more and 500 μm or less, more preferably 1 μm or more and 50 μm or less. When the thickness of the resin layer is 1 μm or more, a developing roller can be obtained, which is prevented from being degraded by wear or the like and is excellent in durability. When the thickness of the resin layer is 500 μm or less, the surface of a developing roller does not have high hardness easily, and degradation and sticking of toner can be suppressed.

<Mandrel>

Any mandrel can be used as long as it has strength required for supporting the elastic layer and the resin layer and conveying the toner, and conductivity capable of serving as an electrode. As a material for the mandrel, there may be given metals such as aluminum, copper, stainless steel, and iron, or alloys thereof, or an electro-conductive synthetic resin. Those materials may be subjected to a plating treatment with chromium or nickel. It should be noted that, for the purpose of allowing the mandrel and the elastic layer formed on an outer side of the mandrel to adhere to each other, a primer may be applied onto the mandrel. An example of the primer is a silane coupling-based primer.

The size of the mandrel is not particularly limited, and the mandrel has, for example, an outer diameter of 4 mm or more and 20 mm or less and a length of 200 mm or more and 380 mm or less.

Figure 3:
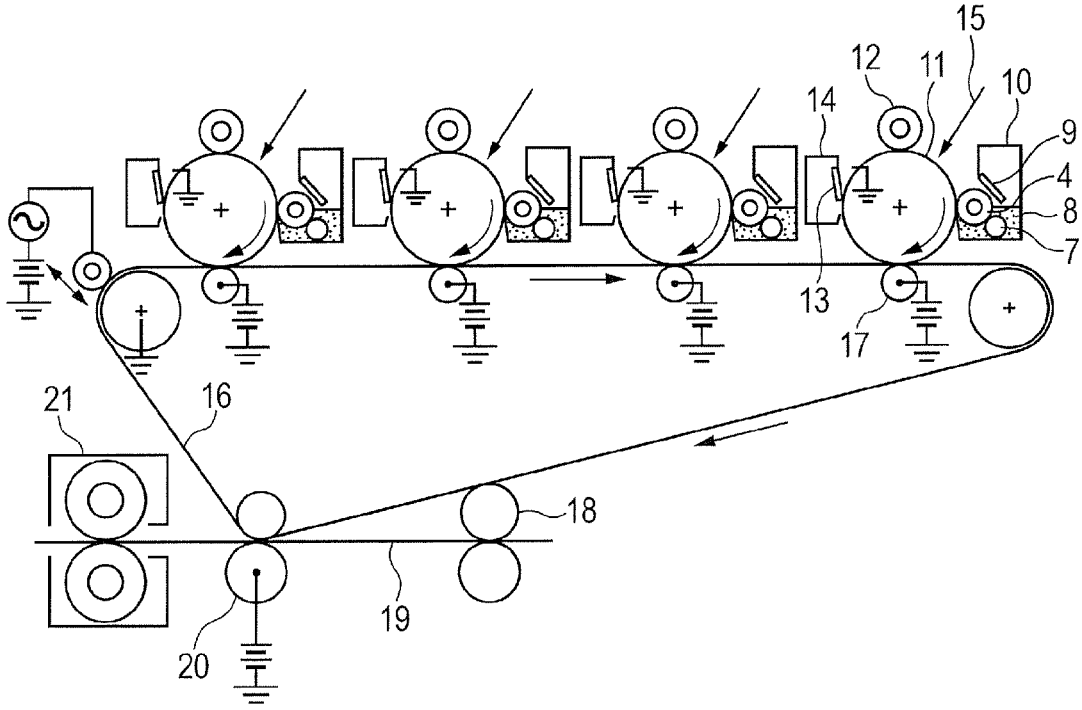
FIG. 3 is a schematic structural view illustrating an example of an electrophotographic apparatus to which a developing roller obtained by the present invention is applied.

FIG. 3 illustrates an example of a schematic configuration of an electrophotographic apparatus including the developing roller of the present invention. The image forming apparatus of FIG. 3 includes a developing device 10 including the developing roller 4, a toner supply roller 7, toner 8, and a developing blade 9. Further, the image forming apparatus includes a photosensitive drum 11, a charging roller 12, a cleaning blade 13, and a waste toner accommodating container 14. The photosensitive drum 11 is rotated in an arrow direction to be uniformly charged by the charging roller 12 for charging the photosensitive drum 11, and an electrostatic latent image is formed on the surface of the photosensitive drum 11 with a laser beam 15 for writing an electrostatic latent image on the photosensitive drum 11. The electrostatic latent image is developed with the toner 8 provided by the developing device 10 placed in contact with the photosensitive drum 11 and visualized as a toner image. During the development, so-called reversal development for forming a negatively charged toner image on an exposure portion is performed.

The visualized toner on the photosensitive drum 11 is transferred onto an intermediate transfer belt 16 by a primary transfer roller 17. The toner image on the intermediate transfer belt 16 is transferred onto a sheet 19 fed from a sheet feed roller 18 by a secondary transfer roller 20. The sheet 19 with the toner image transferred thereto is subjected to a fixing process by a fixing device 21 and delivered outside the apparatus to complete a print operation.

On the other hand, transfer residual toner remaining on the photosensitive drum 11 without being transferred is scraped off with the cleaning blade 13 that is a cleaning member for cleaning the surface of the photosensitive drum to be accommodated in the waste toner accommodating container 14. The thus cleaned photosensitive drum 11 repeats the above-mentioned function.

The developing device 10 includes a developing container accommodating the toner 8 and the developing roller 4 which is positioned at an opening portion extending in a longitudinal direction in the developing container and is set so as to be opposed to the photosensitive drum 11, and is designed so as to develop and visualize the electrostatic latent image on the photosensitive drum 11.

A developing process in the developing device 10 is described below. Toner is applied onto the developing roller 4 with the toner supply roller 7 supported rotatably. The toner applied onto the developing roller 4 is rubbed with the developing blade 9 due to the rotation of the developing roller 4. The developing roller 4 comes into contact with the photosensitive drum 11 while rotating and develops the electrostatic latent image formed on the photosensitive drum 11 with the toner, with which the developing roller 4 has been coated, to form an image.

As a structure of the toner supply roller 7, a foaming skeleton sponge structure or a fur brush structure in which fibers of rayon, polyamide, or the like are planted onto a mandrel is preferred from the viewpoint of supplying the toner 8 to the developing roller 4 and scraping the undeveloped toner. For example, an elastic roller in which a polyurethane foam is provided on a mandrel can be used.

The abutment width of the toner supply roller 7 with respect to the developing roller 4 is preferably 1 mm or more and 8 mm or less. Further, it is preferred to cause the developing roller 4 to have a relative velocity in the abutment portion.

EXAMPLES

The developing roller of the present invention is hereinafter specifically described in detail.

Synthesis of an organopolysiloxane represented by the formula 1 and having a functional group $R^1$ at one terminal of a molecular chain and having a functional group $R^2$ at the other terminal of the molecular chain is described.

(Synthesis of Organopolysiloxane (d-1))

0.24 part by mass of vinyldimethylchlorosilane was added to 100 parts by mass of hydroxy-terminated polydimethylsiloxane (Mw=50,000), and the composition was stirred at a temperature of 90° C. for 4 hours. The resultant liquid was washed with water, and remaining water was removed under reduced pressure. The resultant was analyzed by gel permeation chromatography, and found to have Mw=50,000 and Mw/Mn=1.5. Further, the presence of vinyl groups and hydroxyl groups were confirmed by $^1$H-NMR and $^{29}$Si-NMR analyses.

(Synthesis of Organopolysiloxane (d-2))

0.67 part by mass of vinyldimethylchlorosilane was added to 100 parts by mass of hydroxy-terminated polydimethylsiloxane (Mw=18,000), and synthesis and analysis were performed by the same methods as those of the organopolysiloxane (d-1).

(Synthesis of Organopolysiloxane (d-3))

0.11 part by mass of vinyldimethylchlorosilane was added to 100 parts by mass of hydroxy-terminated polydimethylsiloxane (Mw=110,000), and synthesis and analysis were performed by the same methods as those of the organopolysiloxane (d-1).

(Synthesis of Organopolysiloxane (d-4))

50 parts by mass of hydroxy-terminated polydimethylsiloxane (Mw=10,000) were added to 50 parts by mass of hydroxy-terminated polydimethylsiloxane (Mw=25,000). Further, 0.84 part by mass of vinyldimethylchlorosilane was added to the composition, and synthesis and analysis were performed by the same methods as those of the organopolysiloxane (d-1).

(Synthesis of Organopolysiloxane (d-5))

50 parts by mass of hydroxy-terminated polydimethylsiloxane (Mw=40,000) were added to 50 parts by mass of hydroxy-terminated polydimethylsiloxane (Mw=60,000). Further, 0.25 part by mass of vinyldimethylchlorosilane was added to the composition, and synthesis and analysis were performed by the same methods as those of the organopolysiloxane (d-1).

(Synthesis of Organopolysiloxane (d-6))

50 parts by mass of hydroxy-terminated polydimethylsiloxane (Mw=100,000) were added to 50 parts by mass of hydroxy-terminated polydimethylsiloxane (Mw=120,000). Further, 0.11 part by mass of vinyldimethylchlorosilane was added to the composition, and synthesis and analysis were performed by the same methods as those of the organopolysiloxane (d-1).

(Synthesis of Organopolysiloxane (d-7))

0.24 part by mass of vinyldimethylchlorosilane was added to 100 parts by mass of hydroxy-terminated polydimethylsiloxane (Mw=50,000). Further, 0.25 part by mass of methoxydimethylchlorosilane was added to the composition, and synthesis and analysis were performed by the same methods as those of the organopolysiloxane (d-1).

(Synthesis of Organopolysiloxane (d-8))

0.24 part by mass of vinyldimethylchlorosilane was added to 100 parts by mass of hydroxy-terminated polydimethylsiloxane (Mw=50,000). Further, 0.28 part by mass of ethoxydimethylchlorosilane was added to the composition, and synthesis and analysis were performed by the same methods as those of the organopolysiloxane (d-1).

(Synthesis of Organopolysiloxane (d-9))

0.24 part by mass of vinyldimethylchlorosilane was added to 100 parts by mass of hydroxy-terminated polydimethylsiloxane (Mw=50,000). Further, 0.22 part by mass of aminodimethylchlorosilane was added to the composition, and synthesis and analysis were performed by the same methods as those of the organopolysiloxane (d-1).

(Synthesis of Organopolysiloxane (d-10))

0.24 part by mass of vinyldimethylchlorosilane was added to 100 parts by mass of hydroxy-terminated polydimethylsiloxane (Mw=50,000). Further, 0.25 part by mass of mercaptodimethylchlorosilane was added to the composition, and synthesis and analysis were performed by the same methods as those of the organopolysiloxane (d-1).

(Synthesis of Organopolysiloxane (d-11))

0.67 part by mass of vinyldimethylchlorosilane was added to 100 parts by mass of hydroxy-terminated polydimethylsiloxane (Mw=18,000). Further, 0.69 part by mass of methoxydimethylchlorosilane was added to the composition, and synthesis and analysis were performed by the same methods as those of the organopolysiloxane (d-1).

(Synthesis of Organopolysiloxane (d-12))

0.11 part by mass of vinyldimethylchlorosilane was added to 100 parts by mass of hydroxy-terminated polydimethylsiloxane (Mw=110,000). Further, 0.11 part by mass of methoxydimethylchlorosilane was added to the composition, and synthesis and analysis were performed by the same methods as those of the organopolysiloxane (d-1).

(Synthesis of Organopolysiloxane (d-13))

50 parts by mass of hydroxy-terminated polydimethylsiloxane (Mw=10,000) were added to 50 parts by mass of hydroxy-terminated polydimethylsiloxane (Mw=25,000). Further, 0.84 part by mass of vinyldimethylchlorosilane and 0.87 part by mass of methoxydimethylchlorosilane were added to the composition, and synthesis and analysis were performed by the same methods as those of the organopolysiloxane (d-1).

(Synthesis of Organopolysiloxane (d-14))

50 parts by mass of hydroxy-terminated polydimethylsiloxane (Mw=40,000) were added to 50 parts by mass of hydroxy-terminated polydimethylsiloxane (Mw=60,000). Further, 0.25 part by mass of vinyldimethylchlorosilane and 0.26 part by mass of methoxydimethylchlorosilane were added to the composition, and synthesis and analysis were performed by the same methods as those of the organopolysiloxane (d-1).

(Synthesis of Organopolysiloxane (d-15))

0.67 part by mass of vinyldimethylchlorosilane was added to 100 parts by mass of hydroxy-terminated polydimethylsiloxane (Mw=18,000). Further, 0.77 part by mass of ethoxydimethylchlorosilane was added to the composition, and synthesis and analysis were performed by the same methods as those of the organopolysiloxane (d-1).

(Synthesis of Organopolysiloxane (d-16))

0.11 part by mass of vinyldimethylchlorosilane was added to 100 parts by mass of hydroxy-terminated polydimethylsiloxane (Mw=110,000). Further, 0.13 part by mass of ethoxydimethylchlorosilane was added to the composition, and synthesis and analysis were performed by the same methods as those of the organopolysiloxane (d-1).

(Synthesis of Organopolysiloxane (d-17))

0.67 part by mass of vinyldimethylchlorosilane was added to 100 parts by mass of hydroxy-terminated polydimethylsiloxane (Mw=18,000). Further, 0.61 part by mass of aminodimethylchlorosilane was added to the composition, and synthesis and analysis were performed by the same methods as those of the organopolysiloxane (d-1).

(Synthesis of Organopolysiloxane (d-18))

0.11 part by mass of vinyldimethylchlorosilane was added to 100 parts by mass of hydroxy-terminated polydimethylsiloxane (Mw=110,000). Further, 0.10 part by mass of aminodimethylchlorosilane was added to the composition, and synthesis and analysis were performed by the same methods as those of the organopolysiloxane (d-1).

(Synthesis of Organopolysiloxane (d-19))

0.67 part by mass of vinyldimethylchlorosilane was added to 100 parts by mass of hydroxy-terminated polydimethylsiloxane (Mw=18,000). Further, 0.70 part by mass of mercaptodimethylchlorosilane was added to the composition, and synthesis and analysis were performed by the same methods as those of the organopolysiloxane (d-1).

(Synthesis of Organopolysiloxane (d-20))

0.11 part by mass of vinyldimethylchlorosilane was added to 100 parts by mass of hydroxy-terminated polydimethylsiloxane (Mw=110,000). Further, 0.12 part by mass of mercaptodimethylchlorosilane was added to the composition, and synthesis and analysis were performed by the same methods as those of the organopolysiloxane (d-1).

(Synthesis of Organopolysiloxane (d-21))

0.30 part by mass of butenyldimethylchlorosilane was added to 100 parts by mass of hydroxy-terminated polydimethylsiloxane (Mw=50,000), and synthesis and analysis were performed by the same methods as those of the organopolysiloxane (d-1).

(Synthesis of Organopolysiloxane (d-22))

0.83 part by mass of butenyldimethylchlorosilane was added to 100 parts by mass of hydroxy-terminated polydimethylsiloxane (Mw=18,000), and synthesis and analysis were performed by the same methods as those of the organopolysiloxane (d-1).

(Synthesis of Organopolysiloxane (d-23))

0.14 part by mass of butenyldimethylchlorosilane was added to 100 parts by mass of hydroxy-terminated polydimethylsiloxane (Mw=110,000), and synthesis and analysis were performed by the same methods as those of the organopolysiloxane (d-1).

(Synthesis of Organopolysiloxane (d-24))

0.30 part by mass of butenyldimethylchlorosilane was added to 100 parts by mass of hydroxy-terminated polydimethylsiloxane (Mw=50,000). Further, 0.25 part by mass of methoxydimethylchlorosilane was added to the composition, and synthesis and analysis were performed by the same methods as those of the organopolysiloxane (d-1).

(Synthesis of Organopolysiloxane (d-25))

0.30 part by mass of butenyldimethylchlorosilane was added to 100 parts by mass of hydroxy-terminated polydimethylsiloxane (Mw=50,000). Further, 0.28 part by mass of ethoxydimethylchlorosilane was added to the composition, and synthesis and analysis were performed by the same methods as those of the organopolysiloxane (d-1).

(Synthesis of Organopolysiloxane (d-26))

0.24 part by mass of vinyldimethylchlorosilane was added to 100 parts by mass of hydroxy-terminated polydimethylsiloxane (Mw=50,000). Further, 0.33 part by mass of fluoromethyldimethylchlorosilane was added to the composition, and synthesis and analysis were performed by the same methods as those of the organopolysiloxane (d-1).

(Synthesis of Organopolysiloxane (d-27))

1.20 parts by mass of vinyldimethylchlorosilane were added to 100 parts by mass of hydroxy-terminated polydimethylsiloxane (Mw=10,000), and synthesis and analysis were performed by the same methods as those of the organopolysiloxane (d-1).

(Synthesis of Organopolysiloxane (d-28))

1.20 parts by mass of vinyldimethylchlorosilane were added to 100 parts by mass of hydroxy-terminated polydimethylsiloxane (Mw=10,000). Further, 1.25 parts by mass of methoxydimethylchlorosilane were added to the composition, and synthesis and analysis were performed by the same methods as those of the organopolysiloxane (d-1).

(Synthesis of Organopolysiloxane (d-29))

1.20 parts by mass of vinyldimethylchlorosilane were added to 100 parts by mass of hydroxy-terminated polydimethylsiloxane (Mw=10,000). Further, 1.39 parts by mass of ethoxydimethylchlorosilane were added to the composition, and synthesis and analysis were performed by the same methods as those of the organopolysiloxane (d-1).

(Synthesis of Organopolysiloxane (d-30))

1.20 parts by mass of vinyldimethylchlorosilane were added to 100 parts by mass of hydroxy-terminated polydimethylsiloxane (Mw=10,000). Further, 1.10 parts by mass of aminodimethylchlorosilane were added to the composition, and synthesis and analysis were performed by the same methods as those of the organopolysiloxane (d-1).

(Synthesis of Organopolysiloxane (d-31))

1.20 parts by mass of vinyldimethylchlorosilane were added to 100 parts by mass of hydroxy-terminated polydimethylsiloxane (Mw=10,000). Further, 1.27 parts by mass of mercaptodimethylchlorosilane were added to the composition, and synthesis and analysis were performed by the same methods as those of the organopolysiloxane (d-1).

(Synthesis of Organopolysiloxane (d-32))

0.09 part by mass of vinyldimethylchlorosilane was added to 100 parts by mass of hydroxy-terminated polydimethylsiloxane (Mw=140,000), and synthesis and analysis were performed by the same methods as those of the organopolysiloxane (d-1).

(Synthesis of Organopolysiloxane (d-33))

0.09 part by mass of vinyldimethylchlorosilane was added to 100 parts by mass of hydroxy-terminated polydimethylsiloxane (Mw=10,000). Further, 0.09 part by mass of methoxydimethylchlorosilane was added to the composition, and synthesis and analysis were performed by the same methods as those of the organopolysiloxane (d-1).

(Synthesis of Organopolysiloxane (d-34))

0.09 part by mass of vinyldimethylchlorosilane was added to 100 parts by mass of hydroxy-terminated polydimethylsiloxane (Mw=10,000). Further, 0.10 part by mass of ethoxydimethylchlorosilane was added to the composition, and synthesis and analysis were performed by the same methods as those of the organopolysiloxane (d-1).

(Synthesis of Organopolysiloxane (d-35))

50 parts by mass of hydroxy-terminated polydimethylsiloxane (Mw=5,000) were added to 50 parts by mass of hydroxy-terminated polydimethylsiloxane (Mw=40,000). Further, 1.36 parts by mass of vinyldimethylchlorosilane were added to the composition, and synthesis and analysis were performed by the same methods as those of the organopolysiloxane (d-1).

(Synthesis of Organopolysiloxane (d-36))

50 parts by mass of hydroxy-terminated polydimethylsiloxane (Mw=80,000) were added to 50 parts by mass of hydroxy-terminated polydimethylsiloxane (Mw=150,000). Further, 0.12 part by mass of vinyldimethylchlorosilane was added to the composition, and synthesis and analysis were performed by the same methods as those of the organopolysiloxane (d-1).

(Synthesis of Organopolysiloxane (d-37))

50 parts by mass of hydroxy-terminated polydimethylsiloxane (Mw=5,000) were added to 50 parts by mass of hydroxy-terminated polydimethylsiloxane (Mw=40,000). Further, 1.36 parts by mass of vinyldimethylchlorosilane and 1.40 parts by mass of methoxydimethylchlorosilane were added to the composition, and synthesis and analysis were performed by the same methods as those of the organopolysiloxane (d-1).

(Synthesis of Organopolysiloxane (d-38))

0.33 part by mass of pentenyldimethylchlorosilane was added to 100 parts by mass of hydroxy-terminated polydimethylsiloxane (Mw=50,000), and synthesis and analysis were performed by the same methods as those of the organopolysiloxane (d-1). Table 1 shows the analysis results.

(Synthesis of Organopolysiloxane (d-39))

0.24 part by mass of vinyldimethylchlorosilane was added to 100 parts by mass of hydroxy-terminated polydiethylsiloxane (Mw=50,000), and synthesis and analysis were performed by the same methods as those of the organopolysiloxane (d-1).

(Synthesis of Organopolysiloxane (d-40))

0.56 part by mass of vinylmethyldichlorosilane was added to 100 parts by mass of hydroxy-terminated polydiethylsiloxane (Mw=50,000). Further, 0.43 part by mass of trimethylchlorosilane was added to the composition, and synthesis and analysis were performed by the same methods as those of the organopolysiloxane (d-1). Table 1 shows the analysis results of the organopolysiloxanes (d-1 to d-40).

TABLE 1

| Organopolysiloxane | Mw | Mw/Mn | $R^1$ | $R^2$ | Position of $R^1$ | Functional group other than $R^1$ and $R^2$ |
|---|---|---|---|---|---|---|
| d-1 | 50,000 | 1.5 | Vinyl | Hydroxyl | Molecular chain terminal | Methyl group |
| d-2 | 18,000 | 1.5 | | | | |
| d-3 | 110,000 | 1.5 | | | | |
| d-4 | 18,000 | 2.0 | | | | |
| d-5 | 50,000 | 2.0 | | | | |
| d-6 | 110,000 | 2.0 | | | | |
| d-7 | 50,000 | 1.5 | | Methoxy | | |
| d-8 | 50,000 | 1.5 | | Ethoxy | | |
| d-9 | 50,000 | 1.5 | | Amino | | |
| d-10 | 50,000 | 1.5 | | Mercapto | | |
| d-11 | 18,000 | 1.5 | | Methoxy | | |
| d-12 | 110,000 | 1.5 | | | | |
| d-13 | 18,000 | 2.0 | | | | |
| d-14 | 50,000 | 2.0 | | | | |
| d-15 | 18,000 | 1.5 | | Ethoxy | | |
| d-16 | 110,000 | 1.5 | | | | |
| d-17 | 18,000 | 1.5 | | Amino | | |
| d-18 | 110,000 | 1.5 | | | | |
| d-19 | 18,000 | 1.5 | | Mercapto | | |
| d-20 | 110,000 | 1.5 | | | | |
| d-21 | 50,000 | 1.5 | Butenyl | Hydroxyl | | |
| d-22 | 18,000 | 1.5 | | | | |
| d-23 | 110,000 | 1.5 | | | | |

TABLE 1-continued

| Organopolysiloxane | Mw | Mw/Mn | $R^1$ | $R^2$ | Position of $R^1$ | Functional group other than $R^1$ and $R^2$ |
|---|---|---|---|---|---|---|
| d-24 | 50,000 | 1.5 | | Methoxy | | |
| d-25 | 50,000 | 1.5 | | Ethoxy | | |
| d-26 | 50,000 | 1.5 | Vinyl | Fluoromethyl | | |
| d-27 | 10,000 | 1.5 | | Hydroxyl | | |
| d-28 | 10,000 | 1.5 | | Methoxy | | |
| d-29 | 10,000 | 1.5 | | Ethoxy | | |
| d-30 | 10,000 | 1.5 | | Amino | | |
| d-31 | 10,000 | 1.5 | | Mercapto | | |
| d-32 | 140,000 | 1.5 | | Hydroxyl | | |
| d-33 | 140,000 | 1.5 | | Methoxy | | |
| d-34 | 140,000 | 1.5 | | Ethoxy | | |
| d-35 | 22,000 | 3.0 | | Hydroxyl | | |
| d-36 | 110,000 | 3.0 | | | | |
| d-37 | 22,000 | 3.0 | | Methoxy | | |
| d-38 | 50,000 | 1.5 | Pentenyl | Hydroxyl | | |
| d-39 | 50,000 | 1.5 | Vinyl | | | Ethyl group |
| d-40 | 50,000 | 1.5 | | | Moecular chain non-terminal | Methyl group |

Example 1

(Formation of Elastic Layer)

A mandrel was obtained by applying a primer (trade name: DY35-051, manufactured by Dow Corning Toray Co., Ltd.) onto a cored bar with a diameter of 6 mm made of stainless steel SUS304 and baking the resultant at a temperature of 150° C. for 30 minutes. Then, the mandrel was placed concentrically with respect to a cylindrical mold with an inner diameter of 11.5 mm, and an addition reaction type silicone rubber composition obtained by mixing the components (a) to (e) described in Table 2 was injected into a cavity created in the mold.

TABLE 2

| | |
|---|---|
| (a) Vinyl-terminated polydimethylsiloxane DMS-V42 (trade name, manufactured by GELEST, INC.) | 100 parts by mass |
| (b) Methylhydrosiloxane HMS-301 (trade name, manufactured by GELEST, INC.) | 5 parts by mass |
| (c-1) Carbon Black, Denka Black Powdery Product (trade name, manufactured by DENKI KAGAKU KOGYO CO., LTD.) | 2 parts by mass |
| (c-2) Carbon Black SUNBLACK235 (trade name, manufactured by ASAHI CARBON CO., LTD. ) | 6 parts by mass |
| (d) Organopolysiloxane (d-1) | 1 part by mass |
| (e) Platinum-cyclovinylmethylsiloxane complex SIP6832.2 (trade name, manufactured by GELEST, INC.) | 0.05 part by mass |

In Table 2, the weight average molecular weight of the component (b) is 1,900 to 2,000.

Subsequently, the mold was heated to vulcanize and cure the unvulcanized silicone rubber composition at a temperature of 150° C. for 15 minutes, and the resultant silicone rubber composition was cooled and released from the mold. After that, the silicone rubber composition was further heated at a temperature of 200° C. for 2 hours to complete a curing reaction, and an elastic layer was provided around the mandrel.

(Synthesis of Polyol)

20 parts by mass of an isocyanate compound Millionate MT (trade name, manufactured by Nippon Polyurethane Industry Co., Ltd.) were mixed with 100 parts by mass of polytetramethylene glycol PTG1000SN (trade name, manufactured by Hodogaya Chemical Co., Ltd.) in stages in a methyl ethyl ketone (MEK) solvent. The mixed solution was subjected to a reaction at a temperature of 80° C. for 7 hours in a nitrogen atmosphere to produce the polyether polyol with a hydroxyl value of 20 [mgKOH/g].

(Synthesis of Isocyanate)

In a nitrogen atmosphere, 57 parts by mass of crude diphenylmethane diisocyanate (MDI, trade name: Cosmonate M-200, manufactured by Mitsui Chemicals Polyurethanes, Inc.) were mixed with 100 parts by mass of polypropylene glycol with a number average molecular weight of 400 (trade name: Excenol, manufactured by Asahi Glass Co., Ltd.), and the composition was subjected to a heating reaction at a temperature of 90° C. for 2 hours. After that, butyl cellosolve was added to the resultant so that the solid content became 70% to obtain an isocyanate compound in which the mass ratio of an NCO group contained per solid content was 5.0% by mass. Then, 22 parts by mass of MEK oxime were added dropwise under a condition of a reactant temperature of 50° C. to obtain a block polyisocyanate.

(Production of Resin Layer Coating Material (1))

The block polyisocyanate was mixed with the polyol produced as described above so that the NCO/OH group ratio became 1.4. With respect to 100 parts by mass of a resin solid content of the composition, 20 parts by mass of carbon black (trade name: MA100, manufactured by Mitsubishi Chemical Corporation, pH=3.5) and 30 parts by mass of urethane resin particles (trade name: C400 transparent, manufactured by Negami Chemical Industrial Co., Ltd., average particle diameter: 14 μm) were added, and the composition was dissolved and mixed in MEK so that the total solid content became 35% by mass. The mixed solution was dispersed with a sand mill for 4 hours through use of glass beads with a particle diameter of 1.5 mm to obtain a resin layer coating material (1).

(Formation of Resin Layer on Elastic Layer)

The resin layer coating material 1 obtained as described above was applied onto the elastic layer by dip coating through use of an overflow type dip coating apparatus. The resin layer coating material was dried with air at room temperature for 30 minutes and then subjected to a heat treatment in a hot air circulation oven at 140° C. for 2 hours to obtain a developing roller having a resin layer with a thickness of 12 μm on the surface of the elastic layer.

(Evaluation of Adhesiveness between Elastic Layer and Resin Layer)

Adhesiveness was evaluated by observing film peeling between an elastic layer and a resin layer of a developing roller. The developing roller was left to stand in an environment of a temperature of 40° C. and a humidity of 95% RH for 30 days. After that, the developing roller was further left to stand in an environment of a temperature of 23° C. and a humidity of 50% RH for 24 hours. After the developing roller was left to stand, a peeling test was performed by pressing a cellophane adhesive tape onto a 2-mm crosscut grid in accordance with JIS K5600-5-6 in the same environment, and adhesiveness between the elastic layer and the resin layer was evaluated based on the criteria shown in Table 3.

TABLE 3

| | |
|---|---|
| A | The peeling of the resin layer on the crosscut surface is less than 5%. |
| B | The peeling of the resin layer on the crosscut surface is 5% or more and less than 35%. |
| C | The peeling of the resin layer on the crosscut surface is 35% or more. |

(Evaluation of Fogging)

The developing roller obtained in Example 1 was incorporated into a process cartridge (trade name: CRG-316BLK, manufactured by Canon Inc.) in a laser printer (trade name: LBP5050, manufactured by Canon Inc.) having a configuration as illustrated in FIG. 3, and a fogged image was evaluated.

In an environment of a temperature of 30° C. and a humidity of 80% RH, 3,000 sheets of an image having a printing ratio of 1% were successively output, and thereafter, a white solid image was output. The degree of fogging (fogging value) of the output white solid image was measured by the following method to be 0.5%. Regarding the fogging value, a reflection density of a transfer sheet before formation of an image and a reflection density of a transfer sheet after a white solid image was formed were measured through use of a reflection densitometer (trade name: TC-6DS/A, manufactured by Tokyo Denshoku Co., Ltd.) and a difference between the reflection densities was defined as a fogging value of the developing roller. Regarding measurement of a reflection density, the entire region of an image printing area on a transfer sheet was scanned to measure a reflection density and a minimum value thereof was defined as a reflection density of the transfer sheet.

In a developing roller having a remarkably high resistance, a development field formed between the developing roller and a photosensitive drum cannot be controlled appropriately. When a white solid image is formed through use of such developing roller, a part of toner moves onto the photosensitive drum. Further, when the toner is transferred onto a transfer sheet, fogging is caused. Thus, by evaluating a fogged image, whether or not a resistance of the developing roller is appropriate can be evaluated.

The fogging value was evaluated based on the criteria shown in Table 4. In this case, the following evaluations A and B indicate levels without any practical problems. On the other hand, an evaluation C indicates a level at which "fogging" can be apparently recognized by visual inspection.

TABLE 4

| | |
|---|---|
| A | The fogging value is less than 1.0. |
| B | The fogging value is 1.0 or more and less than 3.0. |
| C | The fogging value is 3.0 or more. |

Examples 2 to 25

The same method as that of Example 1 was performed except that the organopolysiloxane (d-1) was changed to the organopolysiloxanes shown in Table 5 below, and various evaluations were performed. Table 5 shows the results.

Examples 26 to 33

The same method as that of Example 1 was performed except that the organopolysiloxane (d-1) was changed to the organopolysiloxanes shown in Table 5 below and the resin layer coating material (1) was changed to the following resin layer coating material (2), and various evaluations were performed. Table 5 shows the results.

(Production of Resin Layer Coating Material (2))

The same method as that of the resin layer coating material 1 was performed except that the block polyisocyanate was mixed with the polyol so that the NCO/OH group ratio became 1.1 in the production of the resin layer coating material (1). Thus, a resin layer coating material (2) was obtained.

Comparative Example 1

The same method as that of Example 1 was performed except that an elastic layer was formed without adding the organopolysiloxane (d-1), and various evaluations were performed. Table 6 shows the results.

Comparative Example 2

The same method as that of Example 1 was performed except that the organopolysiloxane (d-1) was changed to the organopolysiloxane (d-26), and various evaluations were performed. Table 6 shows the results.

Comparative Example 3

The same method as that of Example 1 was performed except that the organopolysiloxane (d-1) was changed to trimethoxyvinylsilane, and various evaluations were performed. Table 6 shows the results.

Comparative Examples 4 to 17

The same method as that of Example 1 was performed except that the organopolysiloxane (d-1) was changed to the organopolysiloxanes shown in Table 6 below, and various evaluations were performed. Table 6 shows the results.

TABLE 5

| Example | Component (d) in elastic layer Organopolysiloxane | Resin layer NCO/OH group ratio | Adhesiveness | Volume resistivity of elastic layer (Ω · cm) | Fogging |
|---|---|---|---|---|---|
| 1 | d-1 | 1.4 | A | $4.8 \times 10^5$ | A |
| 2 | d-2 | | A | $8.1 \times 10^5$ | A |
| 3 | d-3 | | A | $4.2 \times 10^5$ | A |
| 4 | d-4 | | A | $1.4 \times 10^5$ | A |

TABLE 5-continued

| Example | Component (d) in elastic layer Organopoly-siloxane | Resin layer NCO/OH group ratio | Adhesive-ness | Volume resistivity of elastic layer (Ω · cm) | Fog-ging |
|---|---|---|---|---|---|
| 5 | d-5 | | A | $5.8 \times 10^5$ | A |
| 6 | d-6 | | B | $4.5 \times 10^5$ | A |
| 7 | d-7 | | A | $4.7 \times 10^5$ | A |
| 8 | d-8 | | A | $4.1 \times 10^5$ | A |
| 9 | d-9 | | A | $5.6 \times 10^5$ | A |
| 10 | d-10 | | A | $6.4 \times 10^5$ | A |
| 11 | d-11 | | A | $7.7 \times 10^5$ | A |
| 12 | d-12 | | A | $4.9 \times 10^5$ | A |
| 13 | d-13 | | A | $9.7 \times 10^5$ | A |
| 14 | d-14 | | A | $6.1 \times 10^5$ | A |
| 15 | d-15 | | A | $6.8 \times 10^5$ | A |
| 16 | d-16 | | B | $3.8 \times 10^5$ | A |
| 17 | d-17 | | A | $8.2 \times 10^5$ | A |
| 18 | d-18 | | B | $5.5 \times 10^5$ | A |
| 19 | d-19 | | A | $9.5 \times 10^5$ | A |
| 20 | d-20 | | B | $6.1 \times 10^5$ | A |
| 21 | d-21 | | B | $5.0 \times 10^5$ | A |
| 22 | d-22 | | B | $7.7 \times 10^5$ | A |
| 23 | d-23 | | B | $5.1 \times 10^5$ | A |
| 24 | d-24 | | B | $4.4 \times 10^5$ | A |
| 25 | d-25 | | B | $4.1 \times 10^5$ | A |
| 26 | d-1 | 1.1 | A | $4.8 \times 10^5$ | A |
| 27 | d-2 | | A | $8.1 \times 10^5$ | A |
| 28 | d-3 | | B | $4.2 \times 10^5$ | A |
| 29 | d-5 | | A | $5.8 \times 10^5$ | A |
| 30 | d-7 | | A | $4.7 \times 10^5$ | A |
| 31 | d-8 | | A | $4.1 \times 10^5$ | A |
| 32 | d-9 | | A | $5.6 \times 10^5$ | A |
| 33 | d-10 | | A | $6.4 \times 10^5$ | A |

TABLE 6

| Compar-ative Example | Component (d) in elastic layer Organopoly-siloxane | Resin layer NCO/OH group ratio | Adhesive-ness | Volume resistivity of elastic layer (Ω · cm) | Fog-ging |
|---|---|---|---|---|---|
| 1 | — | 1.4 | C | $3.9 \times 10^5$ | A |
| 2 | d-26 | | C | $1.1 \times 10^6$ | B |
| 3 | Trimethoxy-vinylsilane | | A | $1.9 \times 10^8$ | C |
| 4 | d-27 | | A | $7.9 \times 10^7$ | C |
| 5 | d-28 | | A | $5.3 \times 10^7$ | C |
| 6 | d-29 | | A | $5.9 \times 10^7$ | C |
| 7 | d-30 | | A | $6.1 \times 10^7$ | C |
| 8 | d-31 | | A | $3.6 \times 10^7$ | C |
| 9 | d-32 | | C | $4.2 \times 10^5$ | A |
| 10 | d-33 | | C | $3.6 \times 10^5$ | A |
| 11 | d-34 | | C | $3.2 \times 10^5$ | A |
| 12 | d-35 | | A | $2.8 \times 10^7$ | C |
| 13 | d-36 | | A | $4.4 \times 10^7$ | C |
| 14 | d-37 | | C | $8.8 \times 10^5$ | A |
| 15 | d-38 | | C | $4.4 \times 10^5$ | A |
| 16 | d-39 | | B | $3.1 \times 10^7$ | C |
| 17 | d-40 | | C | $9.8 \times 10^6$ | B |

In Examples 1 to 33, each developing roller had a configuration defined by the present invention. Thus, an elastic layer made of a cured product of a silicone rubber composition and a resin layer made of a thermosetting polyurethane resin adhered to each other firmly. Further, the conductivity of the developing roller was not impaired, and consequently, a satisfactory image with fogging suppressed was obtained.

On the other hand, the adhesiveness between the elastic layer and the resin layer was insufficient in the developing roller of Comparative Example 1. This is because the elastic layer did not contain the component (d) for imparting adhesiveness. The adhesiveness between the elastic layer and the resin layer was insufficient also in the developing roller of Comparative Example 2. This is because the component (d) added to the elastic layer had no functional group capable of reacting with the isocyanate compound in the resin layer.

The developing rollers of Comparative Examples 3 to 8 had a high resistance and poor results of fogging evaluation. The reason for this is considered as follows: the molecular weight of the organopolysiloxane added as the component (d) was too small, which prevented the formation of an electro-conductive path. Further, in the developing rollers of Comparative Examples 9 to 11, the adhesiveness between the elastic layer and the resin layer was insufficient. The reason for this is considered as follows: the molecular weight of the organopolysiloxane added as the component (d) was too large, with the result that a sufficient chemical bond was not able to be formed.

The developing rollers of Comparative Examples 12 and 13 had a high resistance and poor results of fogging evaluation. The reason for this is considered as follows: the content of components having a molecular weight of less than 18,000 became too large owing to large Mw/Mn, which prevented the formation of an electro-conductive path. Further, in the developing roller of Comparative Example 14, the adhesiveness between the elastic layer and the resin layer was insufficient. The reason for this is considered as follows: the content of components having a molecular weight of more than 110,000 became too large owing to large Mw/Mn, with the result that a sufficient chemical bond was not able to be formed.

In the developing roller of Comparative Example 15, the adhesiveness between the elastic layer and the resin layer was insufficient. The reason for this is considered as follows: the number of carbons of alkenyl groups of the component (d) was too large, with the result that a sufficient chemical bond was not able to be formed. The developing roller of Comparative Example 16 had a high resistance and poor results of fogging evaluation. The reason for this is considered as follows: all the functional groups other than $R^1$ and $R^2$ of the component (d) were ethyl groups, and hence a degree of freedom of molecular movement became small, which inhibited the formation of an electro-conductive path.

In the developing roller of Comparative Example 17, the adhesiveness between the elastic layer and the resin layer was insufficient. The reason for this is considered as follows: the functional groups $R^1$ and $R^2$ of the component (d) were positioned at molecular chain non-terminals, with the result that a sufficient chemical bond was not able to be formed.

REFERENCE SIGNS LIST

1 mandrel
2 elastic layer
3 resin layer
4 developing roller
5 elastic roller
6 metal drum
7 toner supply roller
8 toner
9 developing blade
10 developing device
11 photosensitive drum
12 charging roller
13 cleaning blade
14 waste toner accommodating container
15 laser beam
16 intermediate transfer belt
17 primary transfer roller

18 sheet feed roller
19 sheet
20 secondary transfer roller
21 fixing device While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-270638 filed on Dec. 9, 2011 and Japanese Patent Application No. 2012-249648 filed on Nov. 13, 2012, which are hereby incorporated by reference herein in their entirety.

What is claimed is:

1. A developing member, comprising in the following order:

a mandrel;

an elastic layer; and a resin layer, wherein:

the resin layer comprises a polyurethane resin obtained by reacting an isocyanate compound with a polyol compound; and the elastic layer comprises a cured product of an addition polymerization type silicone rubber composition comprising the following (a) to (d):

(a) an organopolysiloxane having two or more alkenyl groups bonded to a silicon atom in one molecule and having a methyl group as a group other than the alkenyl groups bonded to the silicon atom;

(b) an organopolysiloxane having three or more hydrogen atoms bonded to a silicon atom in one molecule and having a methyl group as a group bonded to the silicon atom;

(c) carbon black; and (d) an organopolysiloxane represented by the following formula (1) and having a weight average molecular weight Mw of 18,000 or more and 110,000 or less and a molecular weight distribution Mw/Mn, where Mn represents a number average molecular weight, of 1.0 or more and 2.0 or less:

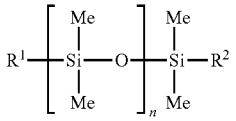

(1)

in the formula (1), $R^1$ represents an alkenyl group having 2 or more and 4 or less carbon atoms, $R^2$ represents a functional group capable of reacting with an isocyanate group, and n represents an integer of 1 or more.

2. The developing member according to claim 1, wherein the functional group capable of reacting with an isocyanate group in the (d) component, comprises a group selected from the group consisting of a hydroxyl group, an alkoxyl group, an amino group, and a thiol group.

3. The developing member according to claim 2, wherein the functional group capable of reacting with an isocyanate group in the (d) component, comprises an alkoxyl group, and the alkoxyl group comprises one of a methoxy group and an ethoxy group.

4. The developing member according to claim 1, wherein the (b) component, has a weight average molecular weight of 300 or more and 100,000 or less.

5. The developing member according to claim 1, wherein the elastic layer has a volume resistivity of $1\times10^4$ Ω·cm or more and $1\times10^7$ Ω·cm or less.

6. An electrophotographic apparatus, comprising:

a photosensitive member; and a developing member placed to abut on the photosensitive member, wherein the developing member comprises the developing member according to claim 1.

* * * * *